US005864085A

United States Patent [19]

Begneu et al.

[11] Patent Number: 5,864,085

[45] Date of Patent: Jan. 26, 1999

[54] AIMING SYSTEM FOR A MOUNTED FIRE ARM

[75] Inventors: Michel Begneu; Bernard Petit, both of Bourges, France

[73] Assignee: Giat Industries, France

[21] Appl. No.: 824,982

[22] Filed: Mar. 27, 1997

Related U.S. Application Data

[63] Continuation of PCT/FR96/01158, Jul. 23, 1996.

[30] Foreign Application Priority Data

Jul. 27, 1995 [FR] France ..... 95 09141

[51] Int. Cl.[6] ..... F41A 23/34

[52] U.S. Cl. ..... 89/37.07; 89/40.03

[58] Field of Search ..... 89/37.07, 37.09, 89/37.13, 40.03, 40.04, 36.08, 36.13, 41.22, 41.19

[56] References Cited

U.S. PATENT DOCUMENTS

| | | | |
|---|---|---|---|
| 2,342,644 | 2/1944 | Colby | 89/36.13 |
| 2,554,019 | 5/1951 | Du Bois | 89/37 |
| 4,353,283 | 10/1982 | Cvepin | 89/37.09 |

FOREIGN PATENT DOCUMENTS

| | | | |
|---|---|---|---|
| 921181 | 4/1947 | France | 89/37.07 |
| 329461 | 11/1920 | Germany | 89/37.07 |
| 1217245 | 5/1966 | Germany . | |
| 977670 | 3/1968 | Germany . | |
| 2349720 | 5/1975 | Germany . | |
| 3739546 | 6/1989 | Germany . | |
| 3121142 | 11/1990 | Germany . | |

OTHER PUBLICATIONS

General Electric, Vulcan Air Defense System Turret, Jul. 1, 1971.

Soderholm, Three–Axis Gun Mount, Design News vol. 15, No. 14, three pages, Jul. 4, 1960.

*Primary Examiner*—Stephen M. Johnson

*Attorney, Agent, or Firm*—Parkhurst & Wendel

[57] ABSTRACT

An aiming system for a fire arm (3) mounted on an armored vehicle in which the gun can travel in elevation and in azimuth following two perpendicular directions, characterized in that the elevation bearing axis (Y'-O-Y) is located in a substantially horizontal plane, when the armored vehicle is standing on substantially horizontal ground, whereas the azimuth bearing axis (Z'-O-Z) is perpendicular to the elevation bearing axis (Y'-O-Y) and also perpendicular to the gun axis.

2 Claims, 4 Drawing Sheets

AIMING SYSTEM FOR A MOUNTED FIRE ARM

This application is a continuation of PCT/FR96/01158, filed on Jul. 23, 1996.

BACKGROUND OF THE INVENTION

1. Field of the Invention

The technical field of the present invention relates to an aiming system for a fire arm mounted, for example, on an armored vehicle of the type in which the gun can move in elevation and in azimuth following two perpendicular axes.

2. Description of the Prior Art

In the case of a fire arm integrated with the turret of an armored vehicle, the gun is generally carried by a cradle which is trunnioned onto a substantially horizontal axis supported by a mantlet to enable the gun to move in elevation, and the mantlet is itself able to revolve around a substantially vertical axis supported by the chassis of the armored vehicle to allow the gun to move in azimuth.

Such an aiming (sometimes referred to as "laying") system is called elevation aiming within azimuth aiming and is notably described in document DE-A-23 49 720.

When the armored vehicle is standing on perfectly horizontal ground, the elevation trunnion axis of the gun is parallel to the horizontal ground reference plane, and the azimuth bearing axis of the gun is perpendicular to the horizontal ground reference plane.

In practical terms, azimuth aiming of the gun is accomplished by pivoting the turret mantlet around the vertical azimuth axis of rotation.

In the particular event that the armored vehicle is a self-propelled vehicle where the turret has been replaced by a fixed casement inside which the gun has been mounted, azimuth aiming of the gun is generally restricted to plus or minus 10°, notably for reasons of safety as regards the crew present in the casement.

In these circumstances, azimuth aiming of the gun is typically accomplished by first aiming the gun by pivoting on the ground the chassis carrying the casement. Thereafter, final accurate azimuth aiming is accomplished by pivoting the gun around the vertical azimuth axis of rotation.

Thus, a system of elevation aiming within azimuth aiming has the disadvantage of limited azimuth aiming when simply rotating the gun of an armored vehicle of the self-propelled type with casemate.

SUMMARY OF THE INVENTION

It is therefore an object of the invention to overcome the above-described azimuth aiming disadvantage for an armored vehicle.

Moreover, during maneuvers or operations, the plane upon which the armored vehicle stands is not necessarily a horizontal plane parallel to the horizontal ground reference plane because of ground variations. That is, the ground plane upon which the armored vehicle stands can be inclined with respect to the horizontal ground reference plane, an inclination which may also be in combination with a certain degree of cant and slope.

Specifically, when the armored vehicle is standing on a horizontal plane parallel to the horizontal ground reference plane, the gun is, for example, aimed at a target and the elevation aiming plane of rotation is then a vertical plane following the gun axis and perpendicular to the horizontal ground reference plane. However, if the armored vehicle is standing on inclined ground, the elevation aiming plane of rotation is then inclined and aiming the gun at the same target requires that azimuthal aiming corrections be made to the gun to bring the gun into the vertical firing plane which is perpendicular to the horizontal ground reference plane.

Having said that, as soon as the armored vehicle is at a cant, azimuth correction increases with the elevation angle to bring the gun axis back to the vertical ground reference firing plane, as will be explained hereafter.

A further object of the invention is to minimize the azimuth correction, when the armored vehicle is on inclined ground, to return the gun axis back into the firing plane perpendicular to the horizontal ground reference plane.

These and other objects of the invention are accomplished by means of an aiming system of a new design for the gun or cannon of an armored vehicle, in particular for a self-propelled vehicle having a chassis with casemate, an aiming system which is characterized in that the elevation bearing axis is located in a horizontal plane, when the armored vehicle is standing on perfectly horizontal ground, whereas the azimuth bearing axis is perpendicular to the elevation bearing axis and also perpendicular to the gun axis.

Thus, according to this aiming system, called azimuth aiming within elevation aiming, the gun is trunnioned onto a cradle around an axis which is perpendicular to the gun axis and to the elevation bearing axis, and supported by a mantlet to enable the gun to travel in azimuth, and the mantlet is mounted to revolve around a substantially horizonal axis supported by the chassis of the armored vehicle to enable the gun to elevate.

According to a first advantage of the invention, the system of azimuth aiming within elevation aiming is particularly well suited to a gun mounted in a casement fixed onto the chassis of an armored vehicle. Namely, such a system increases azimuth bearing correction possibilities when elevation aiming angles increase, whereas it is normally very restricted, for example to plus or minus 10° for an armored vehicle with casement, and minimizes azimuth bearing corrections which have to be made in the vent that the armored vehicle is standing on an inclined plane with respect to the horizontal ground reference plane, to bring the gun firing plane into the vertical ground reference plane.

In a system of elevation aiming within azimuth aiming, in accordance with prior art, a race must be provided in which the mantlet can rotate when the gun travels in azimuth.

In contrast, with the aiming system according to present the invention, such a race can be eliminated, since the mantlet is not mounted rotatably on a vertical axis.

Thus, an aiming system according to the present invention also has the advantage of being compact and of a reduced bulk, which, in the case of an armored vehicle with casement, increases the free space inside the casemate and thereby simplifies installation of automatic loading mechanisms.

BRIEF DESCRIPTION OF THE DRAWINGS

Other advantages, characteristics and particulars of the invention will become apparent from the explanatory description which follows made in reference to the appended drawings, given merely by way of example, in which.

DETAILED DESCRIPTION OF THE INVENTION

Figure 1:
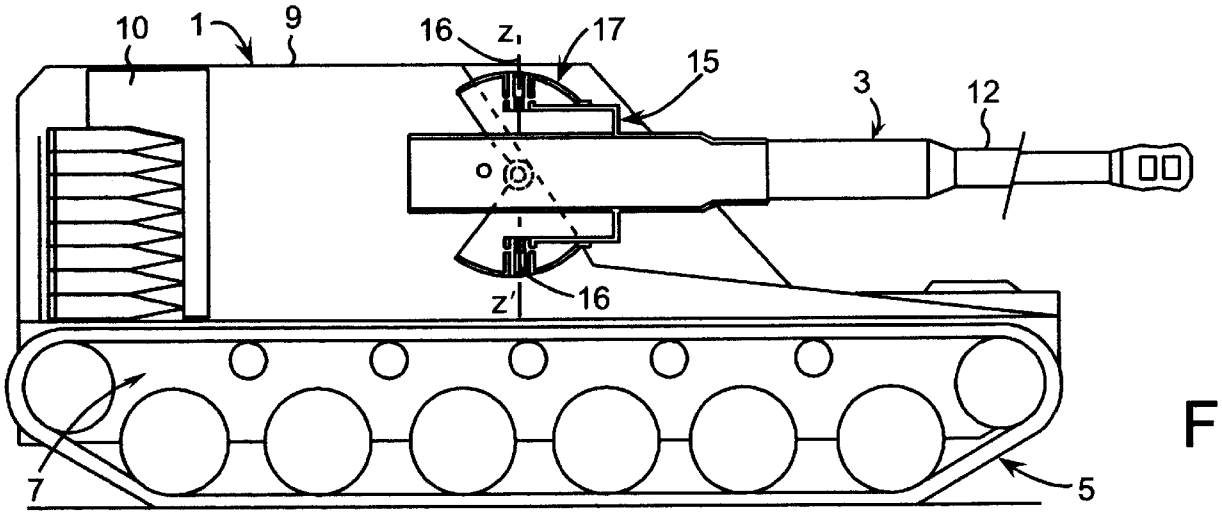
FIG. 1 is a side view of an armored vehicle fitted with an aiming system according to the present invention.
Figure 2:
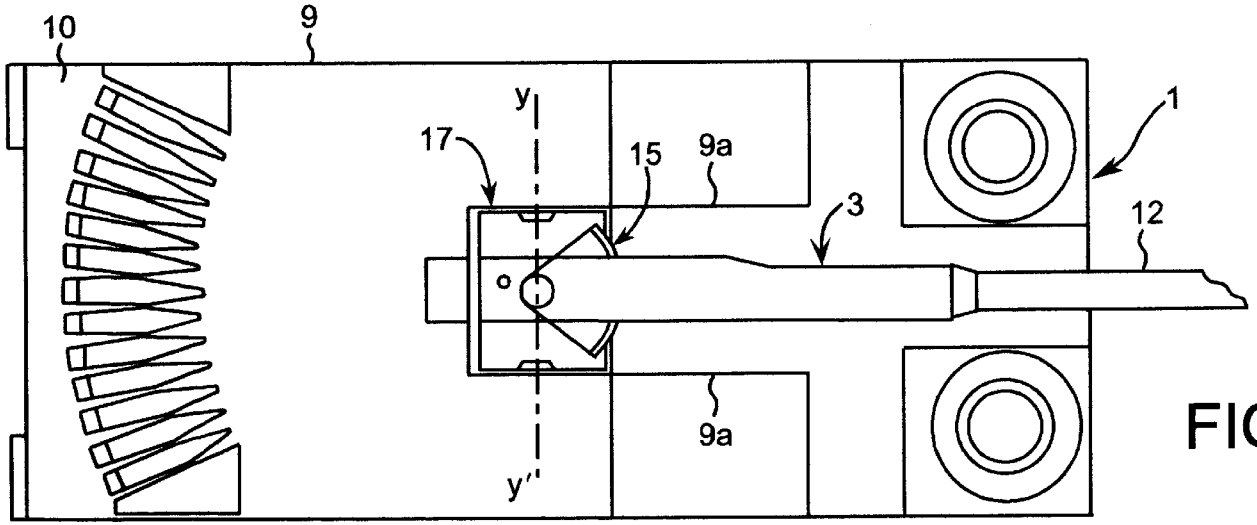
FIG. 2 is a plan view of the armored vehicle of FIG. 1.

An armored vehicle 1 fitted with a fire arm 3 is schematically illustrated in FIGS. 1 and 2. Armored vehicle 1 is, for example, a self-propelled gun mounted on tracks 5 and whose chassis 7 supports a casemate 9. An ammunition magazine 10 is arranged in the rear part of the casemate 9. Gun 3 is mounted in the front part of the casement 9 and is provided with a cannon 12 which projects from the front of the casement 9.

Figure 3:
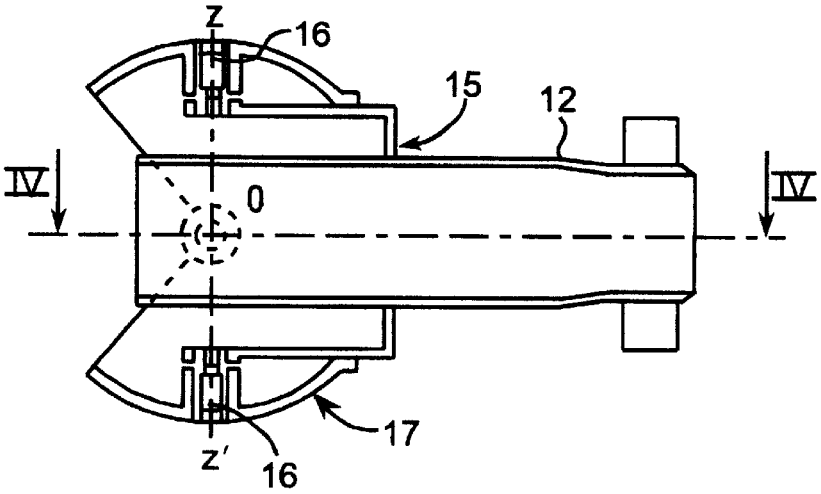
FIG. 3 is a partial section view of the aiming system along line III—III in FIG. 4.

Gun 3 is carried by a cradle 15 which is mounted to rotate around a roughly vertical axis Z'-O-Z, also shown in FIG. 3. Axis Z'-O-Z is provided in practical terms by two half-shafts 16 axially aligned with one another and supported by a mantlet 17 to enable gun 3 to travel in azimuth by rotating around the axis Z'-O-Z.

Figure 4:
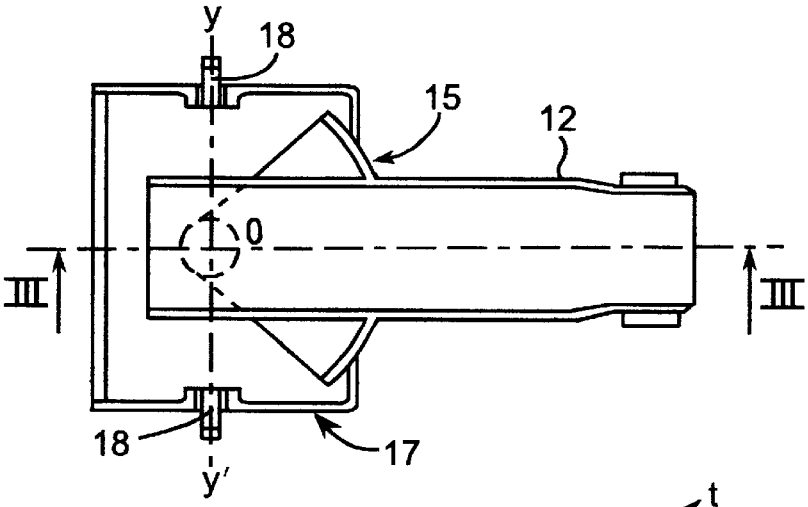
FIG. 4 is a partial section view of the aiming system along line IV—IV in FIG. 3.

Mantlet 17 is itself rotatably mounted around a substantially horizonal axis Y'-O-Y, shown in FIG. 4. Axis Y'-O-Y is provided in practical terms by two half-shafts 18 axially aligned with one another and supported by vertical walls 9*a* of the casement 9 to enable the gun 3 to travel in elevation by rotating around axis Y'-O-Y.

Figure 5:
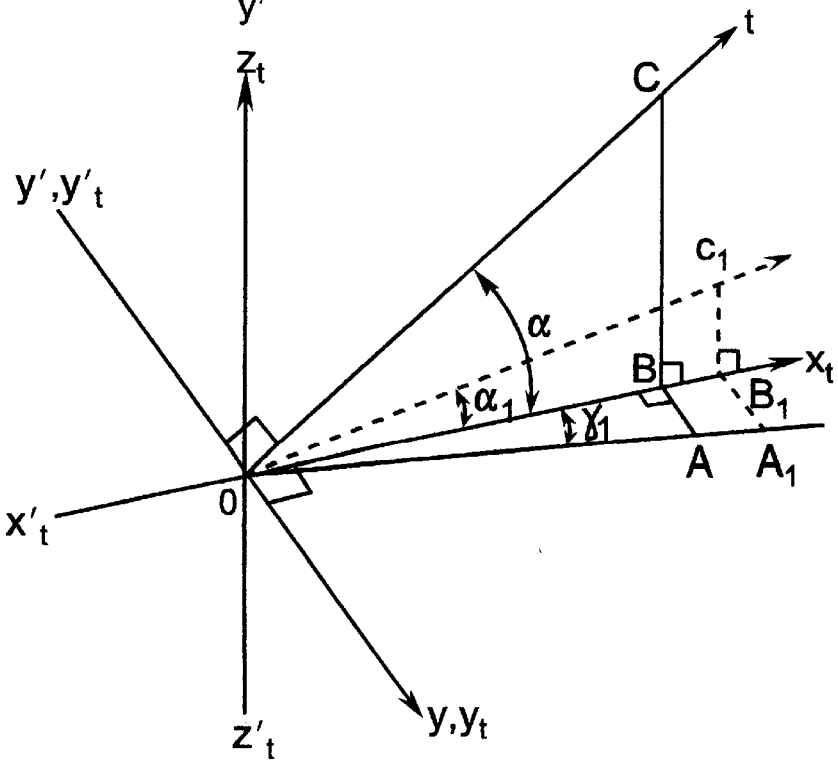
FIG. 5 PRIOR ART
FIG. 5 shows, in a three-dimensional ground reference system, the azimuth aiming angle γ1 for a given elevation angle α in the case of an aiming system according to the prior art and when the armored vehicle is standing on a horizontal plane parallel to the horizontal ground reference plane.

With reference to FIG. 5, a three-dimensional ground reference system is defined by two horizontal axes X't-O-Xt and Y't-O-Yt and by a vertical axis Z't-O-Zt perpendicular to the horizontal ground reference plane defined by the two axes X't-O-Xt, Y't-O-Yt.

For purposes of explanation, suppose that the armored vehicle is standing on the ground along a horizontal plane parallel to the horizontal ground reference plane, that the elevation axis of rotation Y'-O-Y of the cannon is located on the horizonal ground axis X't-O-Xt and that the azimuth axis of rotation Z'-O-Z is located on the vertical ground axis Z't-O-Zt.

In the event that the armored vehicle is fitted with a cannon aiming system according to the prior art, the cannon axis Ot is perpendicular to the elevation axis of rotation Y'-O-Y and a rotation of an angle α around axis Y'-O-Y corresponds to the elevation of the cannon in the vertical firing plane such as defined by a triangle OBC, where B is the point of projection on the horizontal ground axis X't-O-Xt of a point C located on the cannon axis Ot.

The assembly formed by the cannon axis Ot and the elevation axis of rotation Y'-O-Y can pivot around the azimuth axis of rotation Z'-O-Z. A rotation of an angle γ1 around axis Y'-O-Y corresponds to the azimuth of the cannon in the horizontal ground plane X't-O-Xt, Y't-O-Yt which is parallel to the plane upon which the armored vehicle stands on the ground. The angle γ1 is defined by two half-lines OB and OA, where the projection of point A is point B on half-line OB.

It is important to note that angle of rotation γ1 which corresponds to the azimuth of the cannon is independent from the value of angle α which corresponds to the elevation of the cannon. In fact, for an angle α1 different from α point C becomes point C1, and in a rotation in azimuth of an angle γ1, points A and B are only moved to A1 and B1 on the two half-lines OA and OB which mark out the angle of rotation γ1.

Azimuth angle γ1 is generally restricted to plus or minus 10° in the case of an armored vehicle 1 which has a casemate or of a vehicle where the part carrying the gun has a limited azimuth rotation capacity. In the case of a turret, angle γ1 is not limited.

Figure 6:
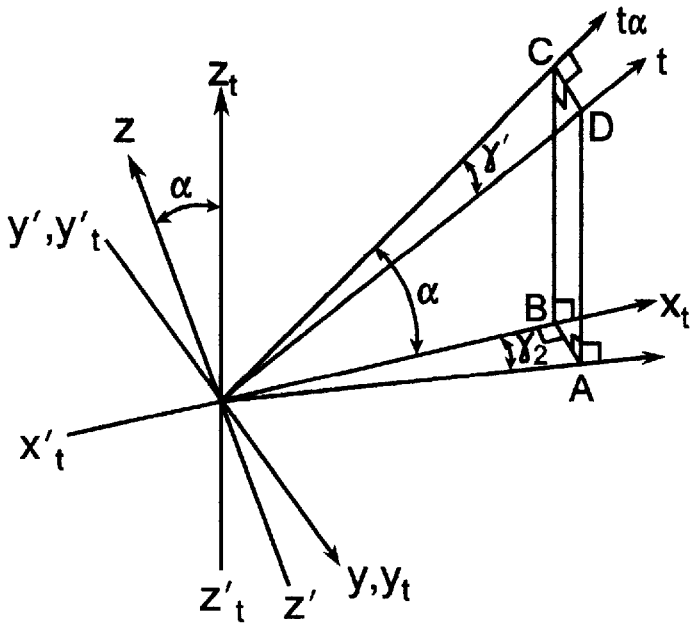
FIG. 6 shows, in a three-dimensional ground reference system, the angle of projection γ2 of the azimuth aiming angle γ' in the horizontal ground reference plane for a give elevation angle α when the armored vehicle is standing on a horizonal plane parallel to the horizonal ground reference plane and is fitted with an aiming system according to the present invention.

With reference to FIG. 6, the same reference system is used as that described in FIG. 5 but for an armored vehicle fitted with a gun aiming system according to the present invention.

In this case, the armored vehicle also stands on the ground on a horizontal plane parallel to the horizonal ground reference plane X't-O-Xt, Y't-O-Yt. The elevation axis of rotation Y'-O-Y is located on the horizontal ground axis Y't-O-Yt. The azimuth axis of rotation Z'-O-Z, perpendicular to the elevation axis of rotation Y'-O-Y and located in the plane of symmetry of the matériel, bears, at right angles and located in the same vertical ground reference plane, the cannon axis Ot. These two, physically connected, axes pivot around the axis of rotation Y'-O-Y of an angle α corresponding to the elevation.

The plane of symmetry of the matériel can be defined by a triangle OBC where point C is a point on the cannon axis Ot and B the projection of point C on the horizontal ground axis X't-O-Xt or longitudinal axis of the matériel. Axis Ot of the cannon makes an angle α with respect to the horizontal ground axis X't-O-Xt, which corresponds to the elevation of axis Ot of the cannon.

A rotation of an angle γ' of the cannon axis Ot around the azimuth axis Z-O-Z' is carried out in an inclined plane OCD perpendicular to the azimuth axis of rotation Z-O-Z', this angle γ' being defined by the two half-lines OC and OD, where C is a point on the cannon axis Ot and D the point on half-line OD whose projection is point C on the cannon axis Ot. The projection γ2 of the azimuth angle γ' on the horizontal ground reference plane X't1-O-Xt2 is marked out between the half-line OB and a half-line OA, where A is the projection point of point D.

Therefore, when the cannon axis Ot pivots around the elevation axis of rotation X'-O-X located in the horizontal ground plane, the azimuth axis of rotation Z-O-Z' inclines with respect to the ground horizontal at the same time as the elevation angle of rotation α varies.

As a result, the projection γ2 of the traverse angle of rotation γ' varies as a function of the elevation angle α.

In fact, taking the right triangle OBA, the following relation is calculated:

$$tg\gamma 2 = \frac{BA}{BO} \quad (1)$$

Taking the right triangle OBC, the following relation is calculated:

$$OB = OC \times \cos\alpha \quad (2)$$

From these two relations (1) and (2), the following calculation can be made:

$$tg\gamma 2 = \frac{AB}{OC} \times \frac{1}{\cos\alpha} \quad (3)$$

However, taking triangle OCD, the following relation is calculated:

$$tg\gamma 2 = \frac{CD \text{ or } AB}{OC} \quad (4)$$

Thus, by combining relations (3) and (4), the following relation is calculated:

$$tg\gamma 2 = \frac{tg\gamma'}{\cos\alpha} \quad (1)$$

where, $$\gamma 2 = \text{Arc}tg\frac{tg\gamma 2}{\cos\alpha} \quad (1)$$

Table 1 below shows the variation in the projection γ2 of the azimuth angle of rotation γ' when the elevation angle α varies (the angles are expressed in decimal degrees).

TABLE 1

| α | γ' | $\gamma^2$ | γ' | $\gamma^2$ | γ' | $\gamma^2$ |
|---|---|---|---|---|---|---|
| 0 | 5 | 5.000 | 10 | 10.000 | 15 | 15.000 |
| 10 | 5 | 5.077 | 10 | 10.151 | 15 | 15.221 |
| 20 | 5 | 5.319 | 10 | 10.628 | 15 | 15.915 |
| 30 | 5 | 5.769 | 10 | 11.508 | 15 | 17.192 |
| 40 | 5 | 6.515 | 10 | 12.962 | 15 | 19.279 |
| 50 | 5 | 7.751 | 10 | 15.340 | 15 | 22.629 |
| 60 | 5 | 9.925 | 10 | 19.425 | 15 | 28.187 |
| 66 | 5 | 12.139 | 10 | 23.438 | 15 | 33.376 |
| 70 | 5 | 14.349 | 10 | 27.273 | 15 | 38.076 |
| 75 | 5 | 18.677 | id | 34.266 | 15 | 45.993 |
| 80 | 5 | 26.740 | 10 | 45.439 | 15 | 57.054 |
| 85 | 5 | 45.109 | 10 | 63.698 | 15 | 71.982 |
| 86 | 5 | 51.434 | 10 | 68.416 | 15 | 75.408 |
| 87 | 5 | 59.112 | 10 | 73.468 | 15 | 78.948 |
| 88 | 5 | 68.253 | 10 | 78.804 | 15 | 82.579 |
| 89 | 5 | 78.719 | 10 | 84.347 | 15 | 86.273 |
| 90 | 5 | 90.000 | 10 | 90.000 | 15 | 90.000 |

Figure 7:
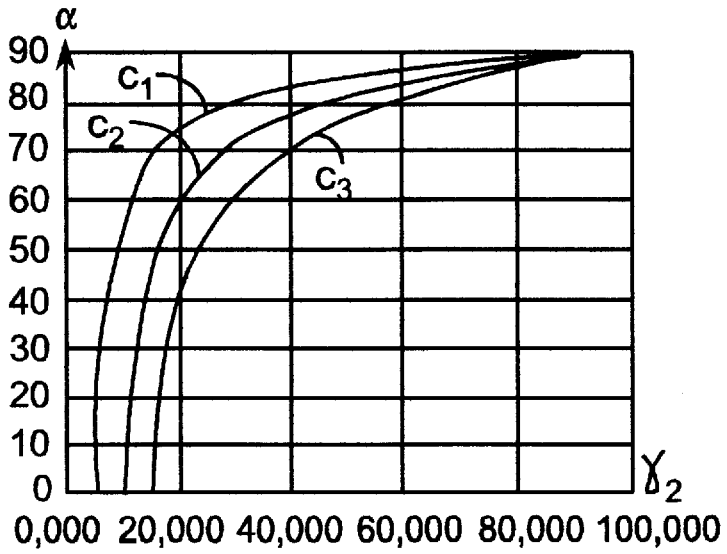
FIG. 7 shows a graph of the variations in the angle of projection γ2 of the azimuth aiming angle γ' as a function of the elevation angle α in an aiming system according to the present invention.

Curves C1, C2 and C3 shown in FIG. 7 take the values of the above table for azimuth angles of rotation γ' having values of 5°, 10° and 15°, respectively.

Thus, in the case of an armored vehicle of the self-propelled type with casement which imposes limited azimuth movement of the cannon axis, there is a limit angle γ1 limited to a maximum value for a system of elevation aiming in azimuth aiming according to the prior art, and a limit angle γ' limited to a maximum value for a system of azimuth aiming in elevation aiming according to the present invention.

As a result, the advantage of azimuth aiming in elevation aiming lies in the evolution of angle γ2, which is the projection of angle γ' in the horizontal ground reference plane, as a function of the elevation angle. This angle γ2 can be compared with the maximum limit of the maximum limit angle γ1 which remains fixed in a system of elevation aiming in azimuth aiming.

The limiting of the azimuth angle to plus or minus 10°, for example in the case of the system of elevation aiming within azimuth aiming, is thus extended by the aiming system according to the present invention.

Specifically, with reference to table T1 above, for an elevation angle α equal to 50° and an azimuth angle of rotation γ' equal to +10°, for example, angle γ2 has a value of +15.340°. In other words, with an aiming system according to the prior art, an azimuth rotation of +15.340 could not be directly obtained by the mere rotation of the gun cannon since this rotation is limited to +10°.

A further advantage of the system of azimuth aiming within elevation aiming is discussed hereafter for the situation where the armored vehicle is not standing on a horizontal plane parallel to the horizontal ground reference plane. Specifically, given ground variations, the armored vehicle can be standing on an inclined plane which is a combination of a certain cant and a certain slope.

For purposes of explanation, suppose that the armored vehicle or the matériel is standing on an inclined plane with a cant d and a slope p.

For a system of elevation aiming within azimuth aiming according to the prior art, the azimuth correction angle ϕ required in the reference system of the armored vehicle to bring the cannon axis Ot into the vertical ground reference plane, as a function of the elevation angle α, the cant d and the slope p, is give by the relation:

$$\phi = \text{arctang}\frac{\sin\alpha \cdot \sin d}{\cos\alpha\sqrt{\cos 2p - \sin 2d} - \sin\alpha \cdot \sin p}$$

For a system of azimuth aiming within elevation aiming, the azimuth correction angle θ in the reference system of the armored vehicle which has to be made to bring the cannon axis Ot into the vertical ground reference plane, as a function of the elevation angle α, of the cant d and the slope p, is give by the relation:

$$\theta = \text{arctang}\left[-\sin\alpha\frac{\sin d}{\sqrt{\cos 2p - \sin 2p}}\right]$$

Comparative Table 2 provides an illustration of the correction values as a function of the variation in elevation angle for each of the two aiming systems in the case of zero slope measured in the firing plane and a cant of 10° measured in the plane perpendicular to the firing plane and to the horizontal ground reference (these two planes are in the ground reference system).

TABLE 2

| d | α | ϕ | θ |
|---|---|---|---|
| 10 | 0 | 0 | 0 |
| 10 | 10 | 1.7817 | −1.75378 |
| 10 | 20 | 3.6796 | −3.45118 |
| 10 | 30 | 5.8430 | −5.03837 |
| 10 | 40 | 8.5085 | −6.46635 |
| 10 | 45 | 10.1559 | −7.10708 |
| 10 | 50 | 12.1305 | −7.69263 |
| 10 | 60 | 17.7827 | −8.6822 |
| 10 | 66 | 23.3307 | −9.15075 |
| 10 | 70 | 28.9767 | −9.40804 |
| 10 | 75 | 41.1522 | −9.6658 |
| 10 | 77 | 49.7965 | −9.74868 |
| 10 | 79 | 65.1108 | −9.81988 |
| 10 | 80 | 90 | −9.85108 |
| 10 | 90 | | −10 |

Figure 8:
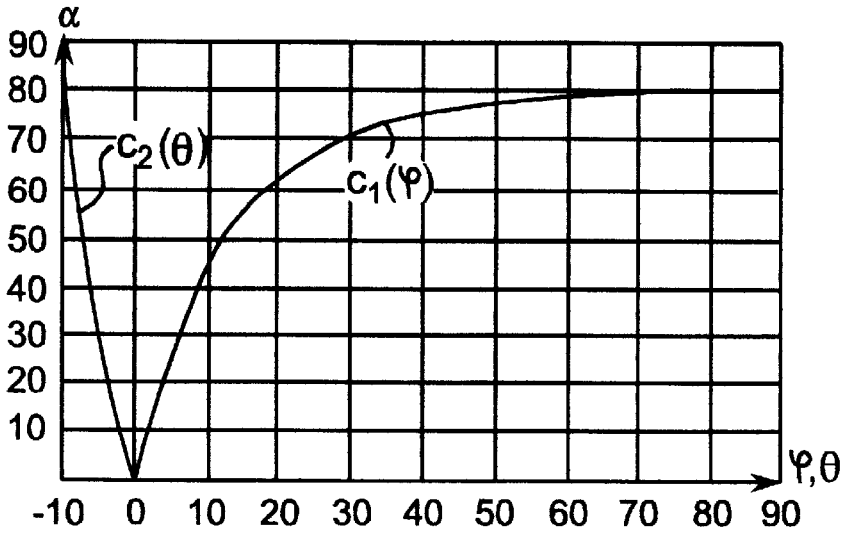
FIG. 8 shows a graph of the variations in azimuth correction angles according to a system in accordance with a prior art and a system in accordance with the present invention.

Table 2 and its representation in graph-form in FIG. 8, show that the azimuth correction in the matériel reference system is notably lower and is limited to a maximum value equal to the cant for the system of azimuth aiming within elevation aiming.

By comparing the two curves C1(ϕ) and C2(θ) in FIG. 8, it can be seen that to correct the deviation of the cannon axis with respect to the vertical firing plane in the case of a cant of 10° and zero slope with respect to this firing plane, the system of elevation aiming within azimuth aiming (prior art) requires an azimuth limit of around 29° for a matériel elevation angle of 70°, whereas the system of azimuth aiming within elevation aiming requires an azimuth limit of 10° maximum whatever the elevation angle of the cannon, this limit being 9.5° for a matériel elevation angle of 70°.

Figure 9:
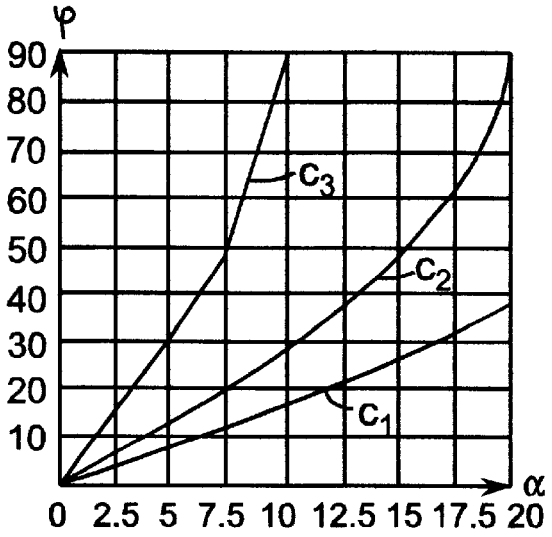
FIGS. 9 and 10 show graphs of the variations of the correction angles.
Figure 10:
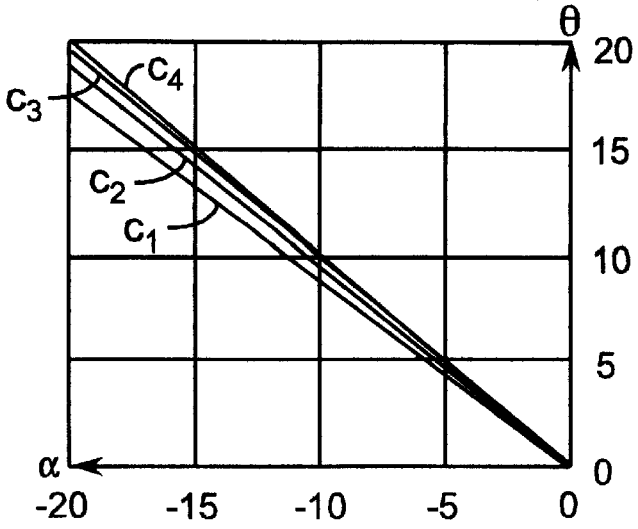

The following Tables 3 and 4 and their graphic representations in FIGS. 9 and 10 show the evolution of the azimuth correction in the matériel reference system as a function of the cant measured in the plane perpendicular to the firing plane and perpendicular to the horizontal in the ground reference system. The slope measured in the vertical firing plane is considered to be zero.

TABLE 3

| d | α | ϕ | α | ϕ | α | ϕ |
|---|---|---|---|---|---|---|
| 0 | 60 | 0 | 70 | 0 | 80 | 0 |
| 5 | 60 | 8.72 | 70 | 13.91 | 80 | 29.75 |
| 10 | 60 | 17.78 | 70 | 28.98 | 80 | 99 |
| 15 | 60 | 27.65 | 70 | 47.41 | 80 | |
| 20 | 60 | 39.08 | 70 | 90 | 80 | |

TABLE 4

| d | α | θ | α | θ | α | θ |
|---|---|---|---|---|---|---|
| 0 | 60 | 0 | 70 | 0 | 80 | 0 |
| −5 | 60 | 4.33 | 70 | 4.69 | 80 | 4.92 |
| −10 | 60 | 8.66 | 70 | 9.40 | 80 | 9.85 |
| −15 | 60 | 13.06 | 70 | 14.13 | 80 | 14.78 |
| −20 | 60 | 17.49 | 70 | 18.88 | 80 | 19.71 |

Table 3 and the curves in FIG. 9 represent the system of elevation aiming within azimuth aiming.

It can be noted, for example, that for a matériel elevation angle α=70°, the required azimuth correction angle ϕ (matériel reference system) increases very quickly with the increase in cant.

$d = 5°$ $\phi = 13.91°$ $d = 10°$ $\phi = 28.98°$ $d = 15°$ $\phi = 47.41°$ $d = 20°$ $\phi = 90.00°$ Table 4 and the curves in FIG. 10 represent the system of azimuth aiming within elevation aiming.

It can be noted that the closer the matériel elevation angle α is to 90°, the closer the required azimuth correction θ (matériel reference system) is to a limit which is equal to the cant.

$d = 5°$ $\phi = \text{max. } 5°$ $d = 10°$ $\phi = \text{max. } 10°$ $d = 15°$ $\phi = \text{max. } 15°$ $d = 20°$ $\phi = \text{max. } 20°$

What is claimed is:

1. An azimuth aiming system for a gun mounted onto a casement of an armored vehicle to permit movement of the gun in elevation and azimuth comprising:

an elevation bearing axis for tilt adjustment located in a substantially horizontal plane and substantially parallel to flat terrain, said elevation bearing axis also being perpendicular to another axis of said gun also located in a substantially horizontal plane;

two horizontal half-shafts coaxial with said elevation bearing axis being in axial alignment with each other and supported at opposing ends by a casement of said armored vehicle;

a mantlet, said mantlet being rotatably mounted for rotation around said two horizontal half-shafts for elevated movement;

an azimuth axis for azimuth adjustment located in a vertical plane substantially perpendicular to said elevation bearing axis, said azimuth axis also being perpendicular to said another axis of said gun;

a cradle having an opening through which a portion of a barrel of said gun extends, said cradle rotatably mounted around said azimuth axis;

said cradle being located within said mantlet so that said mantlet does not require a race and permits movement of the cradle in azimuth; and said mantlet being pivotally connected to said cradle so that said cradle is rotatable about said elevation bearing axis in azimuth within said mantlet to minimize corrections in azimuth to a target as said armored vehicle encounters inclined terrain.

2. The azimuth aiming system of claim 1 wherein said mantlet is pivotally connected to the cradle by a trunnion pin.

* * * * *